US007417381B2

(12) United States Patent
Ohta et al.

(10) Patent No.: US 7,417,381 B2
(45) Date of Patent: Aug. 26, 2008

(54) DISCHARGE LAMP LIGHTING CIRCUIT

(75) Inventors: Shinji Ohta, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 330 days.

(21) Appl. No.: 11/367,106

(22) Filed: Mar. 2, 2006

(65) Prior Publication Data

US 2006/0197467 A1 Sep. 7, 2006

(30) Foreign Application Priority Data

Mar. 4, 2005 (JP) ..... P.2005-060791

(51) Int. Cl.
*H05B 37/00* (2006.01)

(52) U.S. Cl. ..... 315/219; 315/224; 315/307; 315/DIG. 7

(58) Field of Classification Search ..... 315/224, 315/219, 307, DIG. 5, DIG. 7
See application file for complete search history.

(56) References Cited

U.S. PATENT DOCUMENTS 6,919,694 B2 * 7/2005 Moyer et al. ..... 315/224
7,075,246 B2 * 7/2006 Muramatsu et al. ..... 315/219

FOREIGN PATENT DOCUMENTS

JP 7-142182 6/1995

* cited by examiner

*Primary Examiner*—David H Vu
(74) *Attorney, Agent, or Firm*—Fish & Richardson P.C.

(57) ABSTRACT

A DC/AC converter 3 performs AC conversion and a boosting function upon the reception of a DC voltage. A control unit 6 controls the DC/AC converter 3 to perform the lighting control of a discharge lamp. The DC/AC converter includes an AC conversion transformer 7, switching devices 5H, 5L and a resonance capacitor 8, and drives the switching devices to produce series resonance in the capacitor 8 and an inductance component for the transformer 7 or the inductance device 9. Before the discharge lamp 9 is turned on, the drive frequency for the switching devices gradually nears a resonance frequency f1 to increase an unloaded output, and a start signal is supplied to the discharge lamp. After the lighting of the discharge lamp has been initiated, the drive frequency is defined that is higher, by a predetermined frequency displacement value ΔF, than the drive frequency immediately before the discharge lamp is turned on. And the drive frequency for the switching device is shifted to a frequency area fb that is higher than a resonance frequency f2 when the discharge lamp is turned on.

6 Claims, 7 Drawing Sheets

P1→P2→P3→P4

DISCHARGE LAMP LIGHTING CIRCUIT

TECHNICAL FIELD

The present disclosure relates to a discharge lamp lighting circuit to maintain the steady lighting of a discharge lamp.

BACKGROUND

A configuration that comprises a DC power circuit including a DC/DC converter, a DC/AC converter and a starting circuit is known for use as a lighting circuit for discharge lamps, such as metal halide lamps, that may be used as a light source for a vehicle such as an automobile. For example, a DC voltage supplied by a battery maybe converted into a desired voltage by the DC power circuit. Then the desired voltage is converted into an AC signal and is provided by the DC/AC converter at the following stage Thereafter, the AC output may be supplied, with a superimposed start signal, to the discharge lamp (see, for example, Japanese patent document JP-A-7-142182).

In a lighting control of a discharge lamp, a voltage (hereinafter referred to as an "OCV") that is to be provided at an unloaded time, preceding the lighting of the discharge lamp (i.e., while the discharge lamp is turned off), is controlled. After the discharge lamp is turned on, following the reception of the start signal, the discharge lamp is shifted to a steady lighted state as transient input power is gradually reduced.

A switching regulator employing a transformer, for example, is used for the DC power circuit. A full-bridge circuit employing pairs of switching devices, for example, is used for the DC/AC converter.

With a conventional lighting circuit, circuit size and cost problems may be encountered. For example, a transformer used for the DC power circuit and a transformer that constitutes the starting circuit are both required, or the number of switching devices used for the DC/AC converter is increased.

When a discharge lamp is employed, for example, as an automobile light source, a discharge lamp lighting circuit must be arranged within a limited space (e.g., a lighting circuit unit must be accommodated inside a lamp).

The circuit size is increased for an arrangement in which voltage transformation is performed at two steps (DC voltage conversion and DC/AC conversion) and the circuit is not appropriate for downsizing. As a countermeasure for this, an arrangement is proposed in which an output raised at one step through voltage conversion by the DC/AC converter is supplied to a discharge lamp. As an example arrangement, a resonant voltage is raised by employing one transformer and a resonance circuit, and subsequently is supplied to a discharge lamp. Problems in this case are that discrepancies in the characteristics of parts, such as a transformer and a capacitor, are tolerated to a degree to maintain the lighting function, and that the discharge lamp, after being activated, is steadily and quickly shifted to a stable lighted state. When the discharge lamp is employed as an automobile light source, these conditions are required in order to ensure satisfactory safety for night-time running.

SUMMARY

The disclosure below describes a simplification of the configuration of a discharge lamp lighting circuit and may result in a reduction in the number of required parts and a reduction in the manufacturing costs. The disclosure describes steady shifting to a stable lighted state of a discharge lamp which has been activated.

In one aspect, the disclosure describes a discharge lamp lighting circuit comprising: a DC/AC converter, for performing AC conversion upon the reception of an input DC voltage; a starting circuit, for supplying a start signal to a discharge lamp; and a control unit, for controlling power output by the DC/AC converter.

(1) The DC/AC converter may include switching devices to be driven by the control unit and a series resonant circuit that includes either an inductance device or a transformer and a capacitor.

(2) If a resonance frequency for the series resonant circuit when the discharge lamp is turned off is denoted by "f1", and a resonance frequency of the series resonant circuit when the discharge lamp is turned on is denoted by "f2", before the discharge lamp is turned on, the switching devices may be controlled so that a drive frequency for the switching devices gradually approaches f1, and also a start signal maybe supplied to the discharge lamp by the starting circuit.

(3) After lighting of the discharge lamp has been initiated, if the drive frequency for the switching device immediately before the discharge lamp is turned on is employed as a reference, the drive frequency of the switching device may be defined at a level higher by a predetermined frequency displacement value than the reference so that the drive frequency of the switching devices is shifted to a frequency area higher than f2.

Therefore, as the DC/AC converter employs the multiple switching devices to control the drive frequency of the switching devices, and employs a series resonant circuit, which includes either the inductance device or the transformer and the capacitor, the present disclosure provides an effective means for simplifying the circuit configuration, performing high-frequency control and improving the efficiency. Further, the control process for shifting the drive frequency for the switching devices to a frequency higher than f2 is affected less by f1 or f2 fluctuation that may result, for example, from the characteristic discrepancies of the inductance device and the capacitor and the temperature characteristic.

One or more of the following advantages may be present in some implementations. For example, the affect of the characteristic discrepancies produced by the circuit parts and the fluctuation of the ambient condition can be reduced, the lighting function can be maintained, and the lighting shift to a stable lighted state can be ensured.

In the arrangement in which the DC/AC converter includes a transformer that has an AC conversion function and a boosting function related to a start signal, a series resonant circuit may include a capacitor serving as a resonance device and an inductance component serving as the transformer, or an inductance device connected to the capacitor. A resonance voltage generated on a primary side circuit of the transformer is boosted by the transformer, and power is supplied to the discharge lamp connected to a secondary side circuit. As a result, the circuit arrangement can be simplified, and multiple transformers need not be employed, so that downsizing and a reduction in the cost of the circuit can be obtained.

Further, in the control relating to the drive frequency for the switching devices, according to an arrangement that includes a voltage-frequency converter to provide a frequency signal in accordance with an input voltage, the drive frequency for the switching devices may be controlled in accordance with the frequency for the signal from the voltage-frequency converter. After lighting of the discharge lamp has been initiated, an output of the voltage-frequency converter is changed by a predetermined quantity that defines the predetermined frequency displacement value. With this arrangement, the accuracy of the drive frequency may be improved, without the control configuration and the control process becoming complicated.

When the discharge lamp is activated and its lighting is initiated, it is preferable that, in order to maintain a stable lighting status for the discharge lamp, the drive frequency for the switching devices be fixed for a predetermined period immediately after lighting is initiated, instead of changing the drive frequency sooner. During this period, the input to the voltage-frequency converter may be changed by a predetermined value. After the period has elapsed, the drive frequency of the switching devices is increased by the predetermined frequency displacement value, and is shifted to a frequency area higher than f2.

Other features and advantages may be apparent from the following detailed description, the accompanying drawings and the claims.

DETAILED DESCRIPTION OF THE BEST MODE

Figure 1:
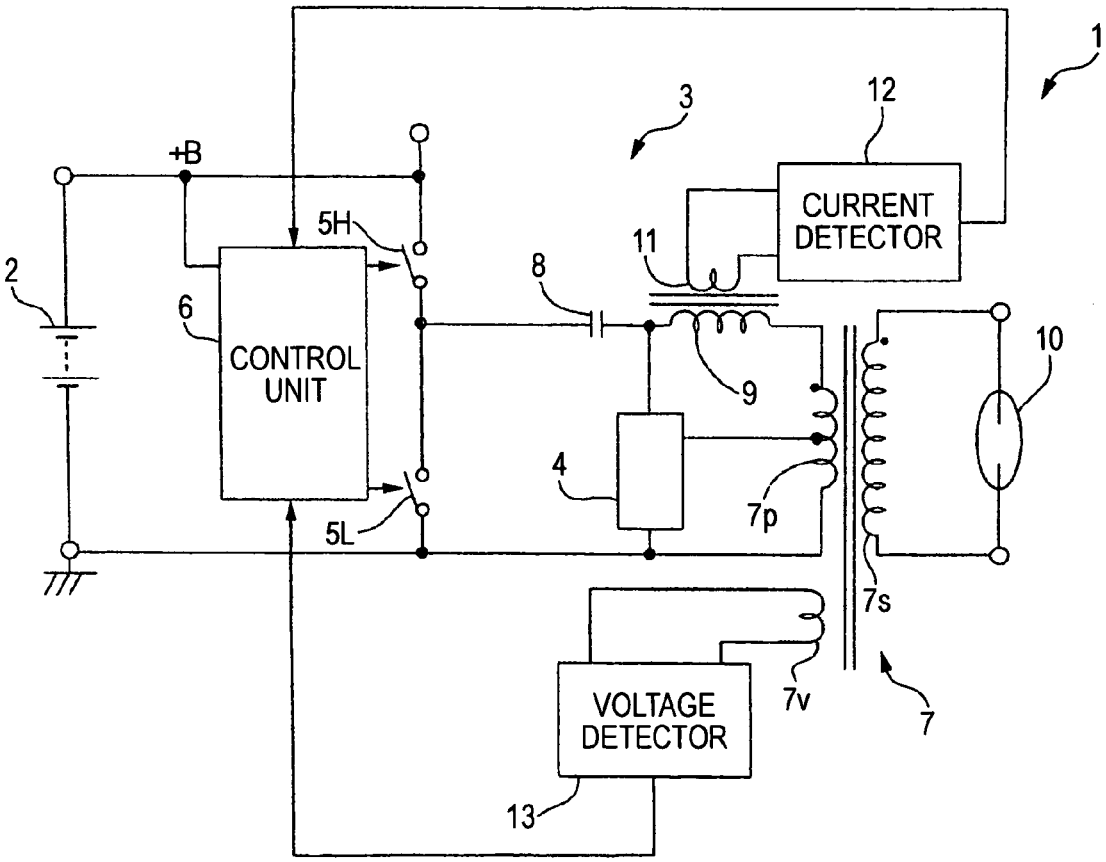
FIG. 1 is a diagram showing an example basic configuration according to the present invention.

FIG. 1 is a diagram showing an example configuration according to the present invention. A discharge lamp lighting circuit 1 includes a DC/AC converter 3 that receives power from a DC power source 2 and a starting circuit 4.

In operaton, the DC/AC converter 3 receives a DC voltage (see "+B" in FIG. 1) from the DC power source 2, and performs AC conversion and voltage boosting. In this embodiment, the DC/AC converter 3 includes two switching devices 5H and 5L and a control unit 6 for driving them. That is, one end of the switching device 5H, at a high stage, is connected to the power terminal, the other end is grounded, at a low stage, through the switching device 5L, and the two devices 5H and 5L are alternately turned on and off by the control unit 6. For simplification, in FIG. 1, the switching devices 5H and 5L are shown using symbols for switches. Semiconductor switching devices, such as field-effect transistors (FETs) or bipolar transistors, may be employed.

The DC/AC converter 3 has a series resonant circuit that includes an inductance device or a transformer and a capacitor. In this embodiment, the DC/AC converter 3 includes a transformer 7 for power conversion, and a circuit structure is provided on the primary side by employing a resonance phenomenon that occurs between a resonance capacitor 8 and an inductor or an inductance component. That is, the following three structure forms can be employed.

(I) a form using resonance occurring between the resonance capacitor 8 and the inductance device;

(II) a form using resonance occurring between the resonance capacitor 8 and the leakage inductance of the transformer 7; or (III) a form using resonance occurring between the resonance capacitor 8 and the inductance device, and the leakage inductance of the transformer 7.

First, according to form (I), an inductance device 9, such as a resonance coil, is provided, and one end of the inductance device 9 is connected to the resonance capacitor 8, and then, the resonance capacitor 8 is connected to a joint for of the switching devices 5H and 5L. The other end of the inductance device 9 is connected to a primary winding 7*p* of the transformer 7.

According to form (II), as the inductance component of the transformer 7 is employed, a resonance coil, for example, need not be additionally provided. That is, one end of the resonance capacitor 8 is connected to the joint for the switching devices 5H and 5L, and the other end is connected to the primary winding 7*p* of the transformer 7.

According to form (III), a series composite reactance of the inductance device 9 and the leakage inductance can be employed.

For each of these forms, by using series resonance produced by the resonance capacitor 8 and an inductive element (the inductance component or the inductance device), the drive frequency for the switching devices 5H and 5L must be defined as a value equal to or higher than a series resonant frequency, and the switching devices must alternately be turned on and off. Thus, sinusoidal lighting can be performed for a discharge lamp 10 (e.g., a metal halide lamp used as a vehicle light) that is connected to a secondary winding 7*s* of the transformer 7. It should be noted that the control unit 6 individually drives the switching devices 5H and 5L so they have opposing states, and so that both switching devices are not in the ON state (depending, for example, on on-duty control). Furthermore, when a resonance frequency before lighting is defined as "f1," a resonance frequency in the lighted state is defined as "f2," the electrostatic capacity of the resonance capacitor 8 is defined as "Cr," the inductance of the inductance device 9 is defined as "Lr" and the primary side inductance of the transformer 7 is defined as "Lp1," a resonance series frequency in form (III), for example, before the discharge lamp is turned on is "$f1=1/(2\cdot\pi\cdot\sqrt{(Cr\cdot(Lr+Lp1))})$". When the drive frequency is lower than f1, loss at the switching devices is increased and the efficiency is deteriorated, so that a switching operation is performed in a frequency area higher than f1. Further, after the discharge lamp is turned on, "$f2\approx1/(2\cdot\pi\cdot\sqrt{(Cr\cdot Lr)})$" is established ($f1<f2$). In this case, the switching operation is also performed in a frequency area higher than f2.

The starting circuit 4 supplies a start signal to the discharge lamp 10. At the time of activation, the output voltage of the starting circuit 4 is raised by the transformer 7, and the boosted voltage is applied to the discharge lamp 10, i.e., the AC converted output, with a start signal superimposed, is supplied to the discharge lamp 10. In this embodiment, one of the output terminals of the starting circuit 4 is connected to the middle of the primary winding 7*p* of the transformer 7, while the other output terminal is connected to one end (the ground terminal) of the primary winding 7*p*. However, the arrangement is not limited to the one described; a voltage input to the starting circuit 4 may be obtained from the secondary side of the transformer 7, or an auxiliary winding (a winding 11 that will be described later) may be provided that, together with the inductance device 9, forms a transformer, and a voltage input to the starting circuit 4 may be obtained from the auxiliary winding.

In the circuit arrangement shown in FIG. 1, the DC/AC converter 3 performs both the conversion of an input DC voltage into AC and the voltage boosting, and controls the supply of power for the discharge lamp 10. Thus, when a current that flows through the discharge lamp 10 and a voltage that is applied to the discharge lamp 10 are to be detected, only an additional winding needs to be provided for the resonance inductance device 9, or for the transformer 7, for the current detected value and the voltage detected value for the discharge lamp 10 to be obtained.

In the example shown in FIG. 1, the auxiliary winding 11, which with the inductance device 9 forms a transformer, is provided in order to detect a current that corresponds to a current that flows through the discharge lamp 10, and the output of the auxiliary winding 11 is transmitted to a current detector 12. That is, current detection for the discharge lamp 10 is performed using the inductance device 9 and the auxiliary winding 11, and the detection results are transmitted to the control unit 6 and are employed either to control the supply of power to the discharge lamp 10 or to identify the lighted state/turned-off state of the discharge lamp 10.

Voltage detection for the discharge lamp 10 is performed based, for example, on the output of a detection winding 7*v* provided for the transformer 7. In this embodiment, the output of the detection winding 7*v* is transmitted to a voltage detector 13, which then obtains a detected voltage that corresponds to a voltage applied to the discharge lamp 10. Thereafter, the detected voltage is transmitted to the control unit 6, and is used to control the supply of power to the discharge lamp 10.

For a discharge lamp, various current detection methods and voltage detection methods can be employed. As an example, a method to provide a current detection resistor for the secondary side circuit of the transformer 7 may be employed. Therefore, any circuit suitable configuration can be employed.

Figure 2:
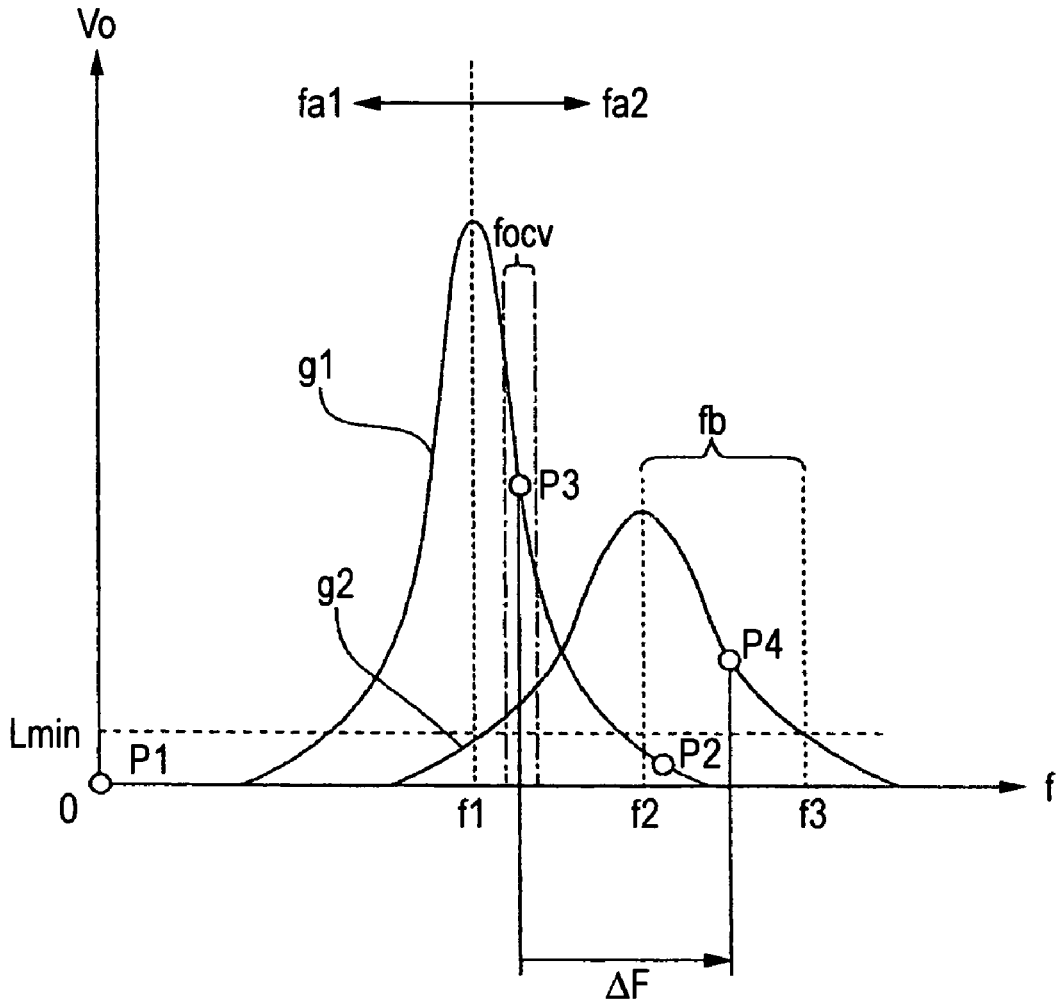
FIG. 2 is a graph for explaining a control process.

FIG. 2 is a schematic graph for explaining the control arrangement. The horizontal axis represents a frequency "f," whereas the vertical axis represents an output voltage "Vo" for the lighting circuit. Also shown are a series resonance curve "g1," when the discharge lamp 10 is turned off, and a series resonance curve "g2," when the discharge lamp 10 is turned on.

When the discharge lamp 10 is turned off, the impedance on the secondary side of the transformer 7 is high, as is the inductance value on the primary side of the transformer 7, and the resonance curve g1 of the resonance frequency f1 is obtained. When the discharge lamp 10 is turned on, the impedance on the secondary side of the transformer 7 is low (about several tens to several hundreds Ω), whereas the inductance value on the primary side is reduced and the resonance curve g2 of the resonance frequency f2 is obtained. (When the discharge lamp 10 is turned on, there is a comparatively small change in the voltage, while there is a great change in the current.)

The definitions of individual symbols shown in FIG. 2 are as follows:

"fa1" a frequency area of "f<f1" (a capacitive area or a phase advancing area located to the left of "f=f1").

"fa2"=a frequency area of "f>f1" (an inductive area or a phase delaying area located to the right of "f=f1").

"fb"=a frequency area of "f>f2" (a frequency area when the discharge lamp 10 is turned on, within an inductive area located to the right of "f=f2").

"focv"=an output voltage control range before lighting (in the turned-off state) (this range is hereafter referred to as an "OCV control range", and is located near f1, within fa2).

"Lmin"=an output level at which lighting of the discharge lamp 10 can be maintained.

"P1"=an operating point before power is switched on.

"P2"=an initial operating point (in area fb) immediately after power is switched on.

"P3"=an operating point (in focv) indicating the time at which a target OCV value is reached after the discharge lamp 10 is turned off.

"P4"=an operating point (in area fb) after the discharge lamp is turned on.

An example of a lighting shift control process related to the discharge lamp 10 is as follows:

(1) Switch on the power to a circuit (P1→P2)

(2) Supply power within the OCV control range (P2→P3)

(3) Generate a start pulse, and apply the start pulse to the discharge lamp 10 (P3)

(4) Fix the value of a lighting frequency (a drive frequency for switching devices) during a predetermined period (hereinafter referred to as a "frequency fixing period") after the lighting of the discharge lamp 10 is initiated (P3)

(5) Shift the lighting control to power control in area fb (P3→P4).

Immediately after the power is switched on, or immediately after the discharge lamp 10 has been turned on once and then turned off, the drive frequency is shifted to the frequency area fb (P1→P2). That is, the frequency is increased temporarily and is then gradually reduced until near f1 (P2→P3).

OCV control is performed within the focv range to generate a discharge lamp start signal, and in response to the supply of this signal, the discharge lamp is turned on. During the OCV control process, for example, when the high frequency is reduced to the resonance frequency f1, the output voltage is gradually raised until it reaches a target value at the operating point P3. Before the discharge lamp 10 is turned on, during an turned-off time period, there is a large switching loss and the circuit efficiency is deteriorated when a method is employed that provides for OCV control in the area fa1. A period during which the circuit is sequentially operated during a no-load time should not be extended more than is necessary when a method is employed that provides for OCV control in the area fa2.

At the operating point P3, when the starting circuit 4 activates the discharge lamp 10 and lighting is initiated, the area focv is shifted to the area fb after the frequency has remained fixed for a predetermined period of time. For this shifting of the area focv to the area fb, either a method for performing it as a single shift, or another for performing it gradually, using several shifts to increase the frequency, can be employed.

Instead of shifting the frequency to the area fb immediately after the lighting of the discharge lamp 10 is initiated, as described in (4), the shift is delayed until the timing for the frequency fixing period has elapsed, to ensure that the state can be shifted to the stable lighted state without a discharge lamp 10 lighting failure and an accompanying unstable lighting condition.

When the discharge lamp 10 is turned off as the result of a cause other than the reception of a switch-off instruction, the lighting shift control process is again entered (e.g., program control is returned to P2 and is then moved to P2, P3 and P4). For example, when the input DC voltage is dropped, the frequency is reduced and program control is shifted to P3).

The following two control conditions must be satisfied for the area fb:

(i) fb must be in an inductive area along the resonance curve g2.

(ii) the output voltage in fb must satisfy "Vo≧Lmin" (or, when the upper limit frequency in fb that satisfies "Vo=Lmin" is denoted by "f3," the frequency should be equal to or lower than f3).

The first condition (i) is related to the ease with which power is controlled. That is, according to the characteristic of the circuit under conditions accompanying the lighting of the discharge lamp 10, since an action taken to limit the fluctuation of the current is applied in the inductive area of the output impedance, this action can effectively stabilize the current that flows through the discharge lamp 10, and power control can be performed easily. On the other hand, in the capacitive area (area to the left of f2), the control process is adversely affected by the fluctuation of the current flowing through the discharge lamp 10, and the supply of power tends to be unstable.

The second condition (ii) is used to define the upper limit frequency in the area fb. When the frequency is set higher than f3 in the area fb, the power supplied to the discharge lamp 10 is reduced, and thus, the discharge lamp 10 would be switched off.

To shift the frequency from focv to fb, the following example methods can be employed:

(A) A method for determining, in advance, a frequency in the area fb that satisfies the conditions (i) and (ii), and for changing to this frequency the frequency at the operating point P3.

(B) A method for determining whether a frequency is present in a capacitive area or in an inductive area, and for starting, at the resonance frequency f2, the supply of power for lighting.

According to method (A), it is difficult to cope with fluctuations in the values of the resonance frequencies f1 and f2 that are affected by part tolerances, characteristic discrepancies and temperature characteristics. For example, even when part discrepancies have been reduced as much as possible, various fluctuation factors should be considered for an application, such as a vehicle lamp, for which a change in the ambient environment will be remarkable. Further, it is advisable that an effect produced by a transient change in a characteristic, for example, seldom occur.

According to method (B), in the application for high frequency control, a determination as to whether the frequency is in the capacitive area or in the inductive area is disabled. Or, even when this determination is enabled and a control process can be performed to prevent the frequency from assuming a level equal to or lower than f2 during the lighting period, in the case of a high frequency circuit, a delay in a response by a comparator, for example, or a logic device cannot be ignored. Thus, method (B) is very practical, although it may require a high-speed and expensive device.

During the control process (OCV control) performed before the discharge lamp 10 is turned on, the drive control process is performed, i.e., the drive frequency for the switching devices gradually approaches f1 to increase the output voltage, and a start signal is supplied to the discharge lamp 10. After the discharge lamp 10 has been turned on, if the drive frequency (corresponding to the frequency at the operating point P3 in FIG. 2) immediately before the discharge lamp 10 is turned on is employed as a reference, the drive frequency is defined that is higher, by a predetermined frequency displacement value (see ΔF in FIG. 2), than the reference. Thus, the drive frequency is shifted to the frequency area fb, which is higher than f2.

As described above in form (III), for example, the resonance frequencies f1 and f2 are "$f1=1/(2\cdot\pi\cdot\sqrt{(Cr\cdot(Lr+Lp1))})$" and "$f2\approx1/(2\cdot\pi\cdot\sqrt{(Cr\cdot Lr)})$." That is, the values of f1 and f2 are affected by the fluctuations of the electrostatic capacitance Cr of the capacitor 8 and the inductance Lr of the inductance device 9, and the value of f1 is also affected by the fluctuation of Lp1.

If the fluctuation of Lp1 is ignored, the fluctuation of Cr or Lr affects and produces the same change trend for f1 and f2, it is found that to shift the frequency from the range focv to the area fb, the method whereby the frequency obtained during the OCV control process is increased by a predetermined frequency value ΔF and is then shifted to the range fb is more preferable, as for accuracy, than is method (A). That is, when the value of Cr or Lr is reduced (or increased), the values of f1 and f2 tend to be increased (or reduced) in accordance with the expressions described above. Since an in-phase relationship is established between the change in the value f1 and the change in the value f2, for example, the value of f2 is reduced when the value of f1 is reduced, so that ΔF can be set to a value that does not depend on changes in the values of f1 and f2. It should be noted, however, that since only the value of f1 is changed by the fluctuation of the value of Lp1, the value of ΔF and the conditions should be designated, while taking various conditions, such as part tolerances and temperature characteristics, into account.

During the process wherein, after the lighting of the discharge lamp 10 has been initiated, the drive frequency of the switching devices is increased and shifted from the frequency before the lighting by the predetermined frequency value ΔF to the area fb in the inductive area "f>f2," the determination performed for the capacitive area or the inductive area is not required, as performed by method (B), and coping with high frequency control (e.g., a drive frequency equal to or higher than two megahertz) is enabled is the present disclosure may be effective for an operation performed to cope with high frequency control and a reduction in the manufacturing costs. In addition, according to method (A), when the fluctuations of the resonance frequencies f1 and f2 are employed, the conditions (i) and (ii) sometimes may not satisfied. However, according to the lighting shift control process described above, a problem due to the fluctuations of the frequencies f1 and f2 can be eliminated, or will seldom occur. That is, when the frequency f is shifted from the range focv to the area fb, by a displacement equivalent to the value ΔF, the frequency f can substantially be prevented from entering the capacitive area, along the curve g2, because the value ΔF is insufficient, or from entering the area beyond f3 because the value ΔF is too great.

An example circuit configuration will now be described with reference to FIGS. 3 and 4.

Figure 3:
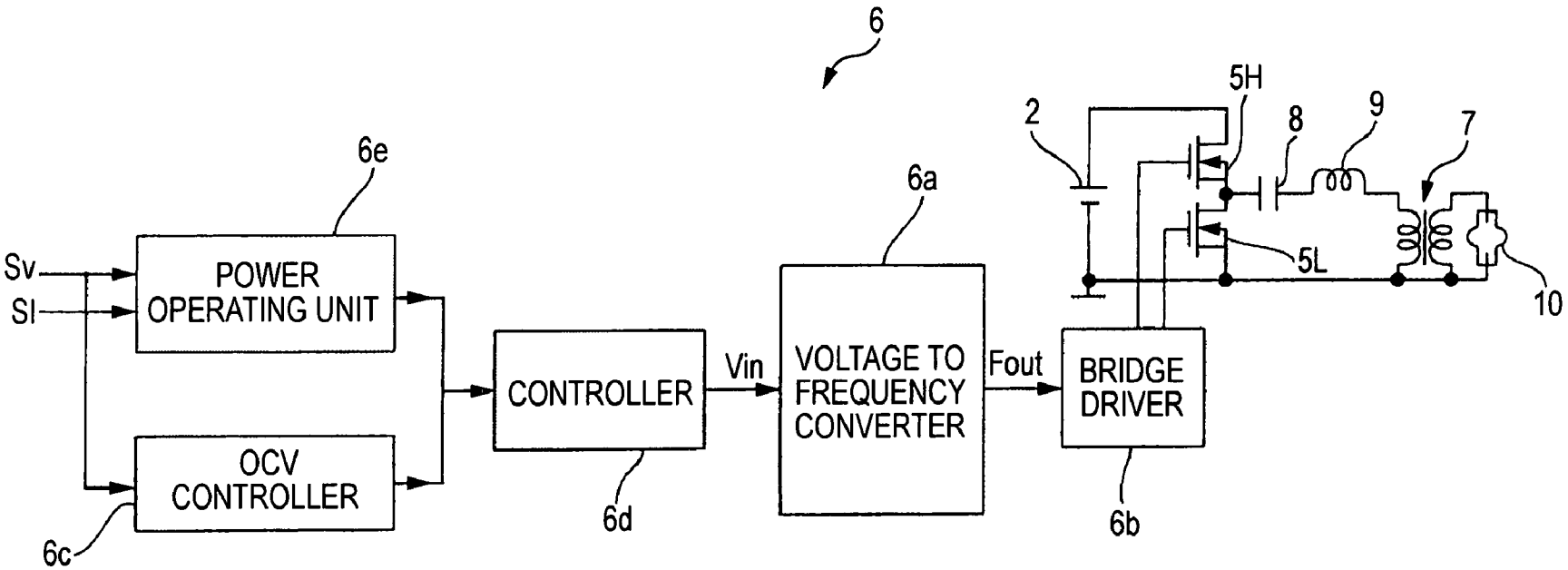
FIG. 3 is a diagram showing an example circuit arrangement for a control unit.

FIG. 3 is a diagram showing an example circuit configuration, mainly for the control unit 6, that employs a voltage-frequency converter (hereinafter referred to as a "V/F converter") for changing a frequency in accordance with an input voltage. In FIG. 3, "Vin" denotes a voltage input to a V/F converter 6*a*, and "Fout" denotes the frequency of an output voltage after conversion by the V/F converter 6*a*.

In this embodiment, the V/F converter 6*a* has control characteristics such that the frequency Fout is as low as the input voltage Vin is high. The output voltage is supplied to a bridge driver 6*b* at the succeeding stage, and the signal output by the bridge driver 6*b* is supplied to the control terminals of the switching devices 5H and 5L. In the control process for the frequency area fb, for example, when the value of the frequency Fout is as low as the value of the voltage Vin is high, accordingly, the output power (or the output voltage) is increased, or when the value of the frequency Fout is as high as the value of the voltage Vin is low, the output power (or the output voltage) is reduced.

An OCV controller 6*c* is a circuit for controlling an unloaded output voltage before the discharge lamp 10 is switched on, and the signal output by the OCV controller 6*c* is supplied to a controller 6*d*. The OCV controller 6*c* has a function whereby, during the OCV control process, power to be supplied to the discharge lamp 10 is increased as the frequency is reduced, and is constituted by an operational amplifier that employs, as an input signal, a discharge lamp voltage detection signal (denoted by "Sv") obtained by the voltage detection circuit 13.

A power operating unit 6*e* for controlling the power to be supplied to the discharge lamp 10 is a circuit that controls the power to be supplied when the discharge lamp 10 is switched on, and is thereafter shifted to the area fb, or when the discharge lamp is in the stable state. The signal output by the power operating unit 6*e* is supplied to the controller 6*d*, and an arbitrary configuration is applied for the power operating unit 6*e* of this invention. Provided, for example, is an operational amplifier that receives a voltage detection signal Sv, for the discharge lamp 10, and a current detection signal (denoted by "SI") obtained by the current detection circuit 12 and calculates a power value based on these signals, or a limiter that limits the control output to prevent the drive frequency f from dropping below the resonance frequency f2 when the discharge lamp is on.

The controller 6*d* receives signals output by the OCV controller 6*c* and the power operating unit 6*e*, and outputs a voltage to the V/F converter 6*a*. The controller 6*d* includes an error amplifier and a sample hold circuit, and a specific circuit arrangement for the controller 6*d* that will be described later.

The input voltage Vin for the V/F converter 6*a* is a control voltage related to frequency control for the switching devices 5H and 5L, and in this embodiment is defined as a voltage output by the OCV controller 6*c* and the power operating unit 6*e* through the controller 6*d*. A signal at the frequency fout, which is obtained by converting this output voltage, is supplied as a control signal through the bridge driver 6*b* to the switching devices 5H and 5L.

As described above, when the discharge lamp 10 is switched on, the switching devices 5H and 5L are alternately driven at the drive frequency in the area fb, and power control is provided for the discharge lamp 10. In the arrangement shown in FIG. 3 that includes the transformer 7 and the capacitor 8, the capacitor 8 and the primary side leakage inductance component of the transformer 7, or the inductance device 9 connected to the capacitor 8, form a resonant series circuit. A resonance voltage generated by the primary side circuit of the transformer 7 is boosted by the transformer 7, and power is supplied to the discharge lamp 10 connected to the secondary side circuit of the transformer 7.

Figure 4:
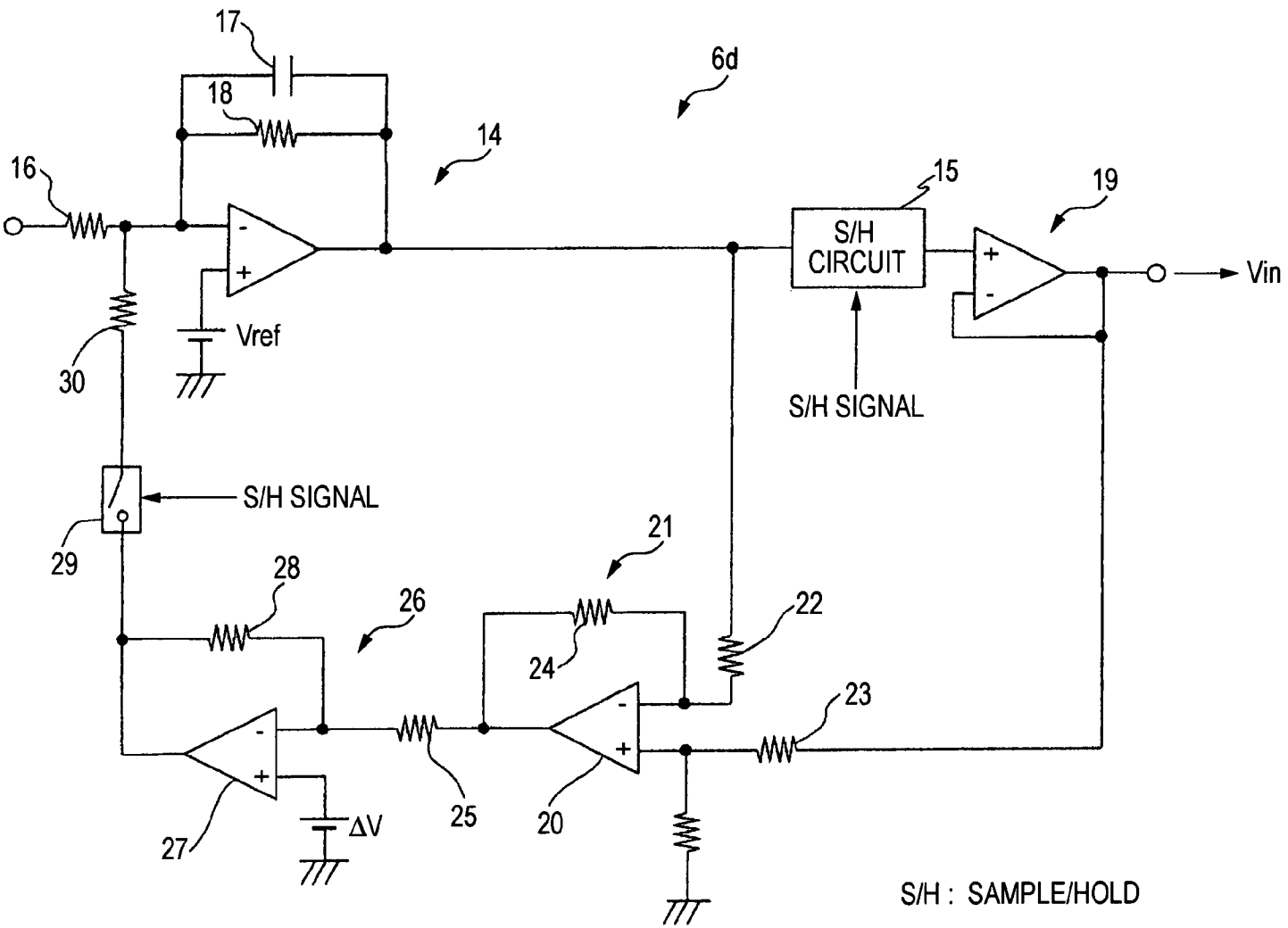
FIG. 4 is a circuit diagram showing a portion of the control unit.

FIG. 4 is a diagram showing an example circuit configuration for the controller 6*d*. The controller 6*d* includes an error amplifier 14 located at the succeeding stage of the power operating unit 6*e* and a sample holding circuit (hereinafter referred to simply as an "S/H circuit") 15 at the succeeding stage of the error amplifier 14.

Signals provided by the OCV controller 6*c* and the power operating unit 6*e* are supplied through a resistor 16 to the negative input terminal of the error amplifier 14, while a capacitor 17 and a resistor 18 are inserted and connected in parallel between the negative input terminal and the output terminal of the error amplifier 14. A predetermined reference voltage "Vref" (denoted as a constant voltage power source in FIG. 4) is applied to the positive input terminal of the error amplifier 14.

A signal (a sample hold signal) is supplied by a signal generator (not shown) to the S/H circuit 15. When, for example, the level of the discharge lamp current detection signal SI is compared with a predetermined reference value and it is detected that the-discharge lamp 10 is turned on, a sample hold signal having a predetermined pulse width is generated and is supplied to the S/H circuit 15. Then, signal holding is performed during a period (corresponding to the frequency fixing period) in which the sample hold signal is at level H.

The signal provided by the S/H circuit 15 is supplied to the positive input terminal of a buffer amplifier 19 at the succeeding stage, and the output voltage of the buffer amplifier 19 is supplied as the input voltage "Vin," described above, to the V/F converter 6*a*.

The output signal of the error amplifier 14 and the output signal of the buffer amplifier 19 are supplied to a differential amplifier 21 that employs an operational amplifier 20. That is, a signal output by the error amplifier 14 is supplied through a resistor 22 to a negative input terminal (an inverted input terminal) of the operational amplifier 20, and a signal output by the buffer amplifier 19 is supplied through a resistor 23 to a positive input terminal (a non-inverted input terminal) A resistor 24 is inserted between the negative input terminal (the inverted input terminal) and the output terminal of the operational amplifier 20.

The output signal of the differential amplifier 21 is supplied through a resistor 25 to a differential amplifier 26. That is, the differential amplifier 26 is constituted by using an operational amplifier 27, a signal provided by the differential amplifier 21 is received by the negative input terminal of the operational amplifier 27, and a voltage (denoted by "ΔV"; indicated as a constant voltage power source in FIG. 4) corresponding to the value ΔF is applied to the positive input terminal. A resistor 28 is inserted between the negative input terminal (the inverted input terminal) and the output terminal of the operational amplifier 27.

The output terminal of the differential amplifier 26 is connected to the negative input terminal of the error amplifier 14 through an analog switch device 29 and a resistor 30. The analog switch device 29 is turned on or off upon the reception of a sample hold signal, and in this embodiment, the analog switch device 29 is turned on when the sample hold signal is at level H.

With this circuit arrangement, the circuit section including the differential amplifiers 21 and 26 operates, using the input of the error amplifier 14, only during a period wherein the sample hold signal is at level H, which corresponds to the frequency fixing period. That is, a feedback loop is formed in consonance with the input to the error amplifier 14 in order to maintain a constant value "ΔV" for a signal that indicates a difference between the output of the error amplifier 14 and the output of the S/H circuit 15, and the voltage input to the V/F converter 6*a* is changed during a predetermined period (a frequency fixing period) immediately after the lighting of the discharge lamp 10 is initiated. As the level of the voltage Vin is dropped by ΔV after the timing for the frequency fixing period has elapsed, the drive frequency is raised by the frequency displacement value ΔF. As a result, as described above, the drive frequency is shifted from the range focv to the area fb, i.e., after the discharge lamp 10 is turned on, the drive frequency is precisely shifted to the area (the inductive area) to the right of the resonance frequency f2.

Figure 5:
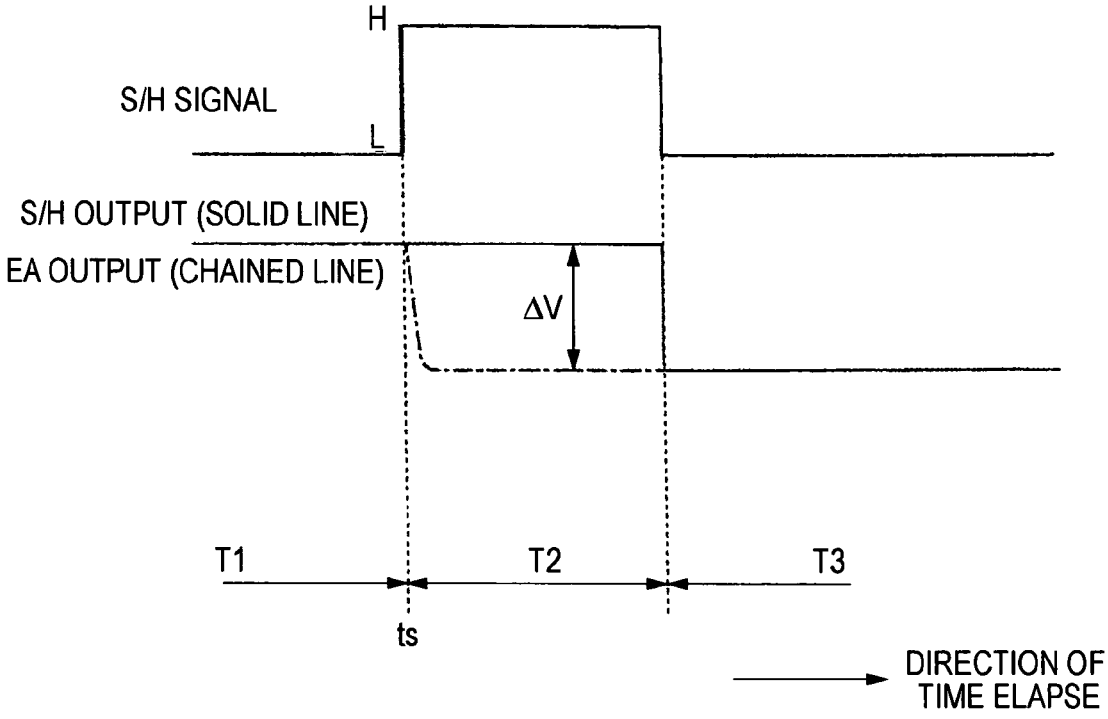
FIG. 5 is a schematic diagram showing the signal waveforms of the individual sections in FIG. 4.

FIG. 5 is a diagram showing example signal waveforms for individual sections. The definitions for the signals and symbols in FIG. 5 are as follows:

"S/H signal"=sample hold signal to be supplied to the S/H circuit 15 and the analog switch device 29.

"S/H output"=signal output by the S/H circuit 15.

"EA output"=signal output by the error amplifier 14.

"T1"=period in the OCV control range before lighting.

"T2"=frequency fixing period.

"T3"=power control period in the area fb following the frequency fixing period.

"ts"=discharge lamp lighting initiation time.

As shown in FIG. 5, during a predetermined period (T2) following ts, the level of the S/H output is fixed, and after the timing for this period has elapsed, is dropped by "ΔV" when the S/H signal is changed from level H to level L. That is, the voltage Vin is lowered by a value equivalent to this voltage drop, and as a result, the drive frequency is increased by the value ΔF and is used for power control during the period T3.

However, when a method for temporarily adjusting the voltage output by the amplifier 19, or a method whereby the frequency displacement value that corresponds to the value ΔF is added by the V/F converter 6*a* is employed for the arrangement wherein the output frequency Fout of the V/F converter 6*a* is changed in accordance with the output of the error amplifier 14, the succeeding feedback control process using the error amplifier 14 cannot be performed, e.g., the temporary adjustment would cause a control stabilization problem. Therefore, as in this embodiment, it is preferable that during the frequency fixing period "T2" the input of the error amplifier 14 be adjusted and the output of the error amplifier 14 be lowered by ΔV, by using the differential amplifiers 21 and 26, and that, following the elapse of the timing for this period, power control be started at a frequency in the area fb that has been raised by ΔF.

Figure 6:
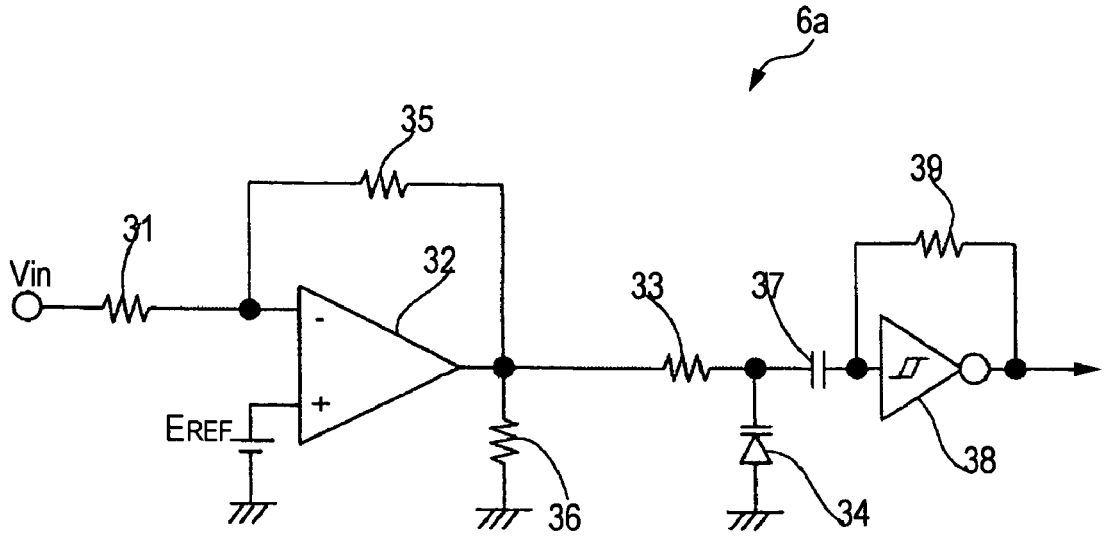
FIG. 6 is a diagram showing an example arrangement for a V/F converter.

FIG. 6 is a diagram showing a portion of an example arrangement for the V/F converter 6*a*.

The voltage Vin output by the controller 6*d* is applied through a resistor 31 to the inverted input terminal of an operational amplifier 32. A predetermined reference voltage "EREF" is applied to the non-inverted input terminal of the operational amplifier 32, and a signal output by the operational amplifier 32 is supplied through a resistor 33 to a voltage variable-capacitance diode 34. A resistor 36 is inserted between the non-inverted input terminal and the output terminal of the operational amplifier 32, and that one end of a resistor 36 is connected to the output terminal of the operational amplifier 32 and the other end is grounded.

The cathode of the voltage variable-capacitance diode 34 is connected between the resistor 33 and a capacitor 37, and the anode is grounded. The input terminal of a NOT gate 38, of a Schmitt trigger type, is connected through the capacitor 37 to the cathode of the voltage variable-capacitance diode 34, and a resistor 39 is connected parallel to the NOT gate 38. These devices constitute a frequency variable oscillation circuit, and the output pulse of the NOT gate is supplied to the bridge driver 6*b* at the succeeding stage.

In this embodiment, when the level of the voltage Vin goes high (low), the output voltage of the operational amplifier 32 is dropped (raised), and the electrostatic capacitance of the voltage variable-capacitance diode 34 is increased (reduced). Therefore, the frequency of the output pulse is lowered (raised).

Figure 7:
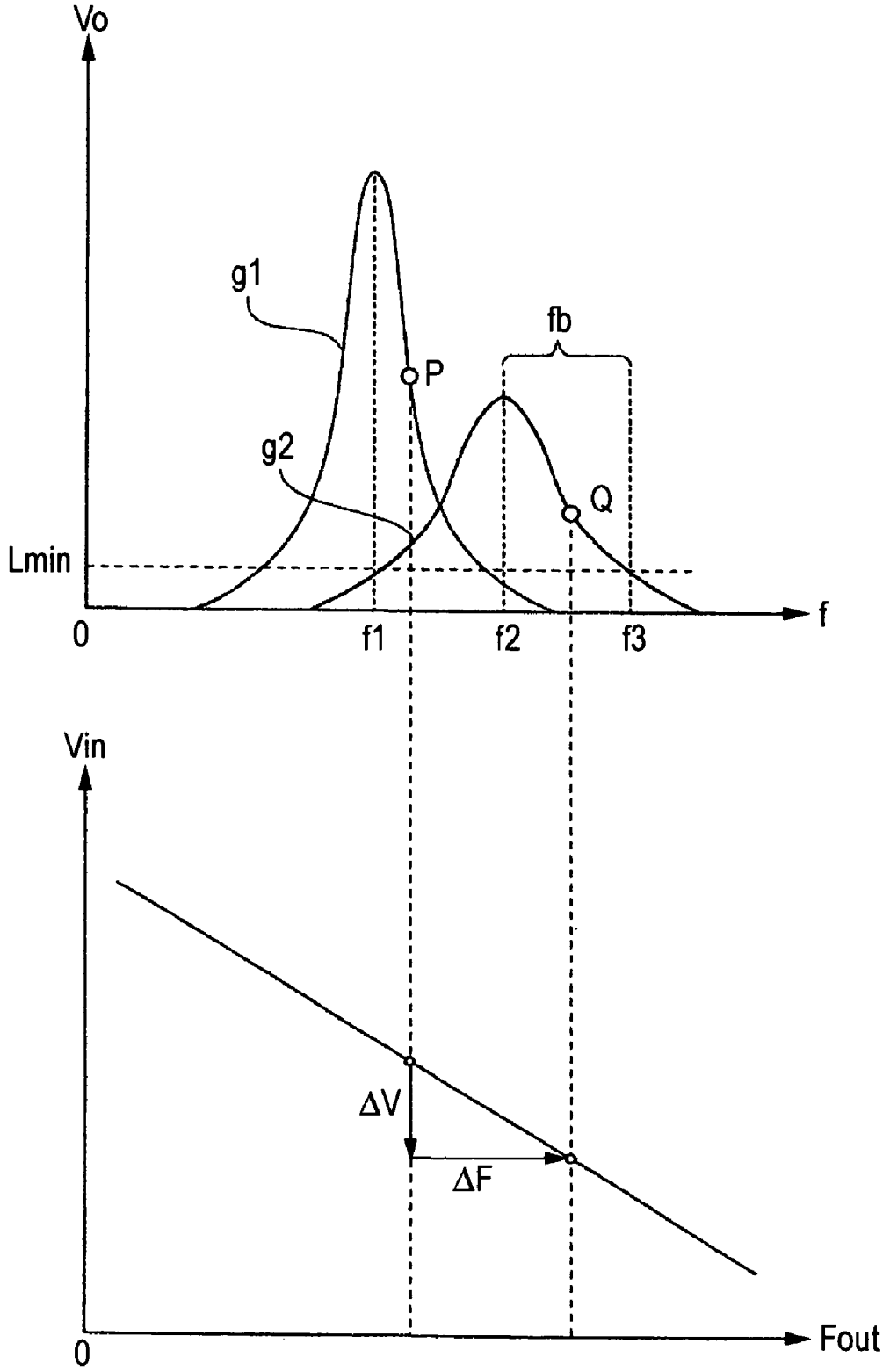
FIG. 7 is a graph for explaining a control operation.

FIG. 7 is a diagram showing schematic graphs for explaining the foregoing control operation. As in FIG. 2, in the upper graph, the horizontal axis represents a frequency "f," while the vertical axis represents an output voltage "Vo," and resonance curves g1 and g2 are shown. In the lower graph, the input/output characteristic of the V/F converter 6*a* is shown, and the horizontal axis represents the output frequency "Fout" of the V/F converter 6*a*, while the vertical axis represents the input voltage "Vin."

In the upper graph, an operating point P, located in the area f1, near the high frequency side, along the curve g1, represents the state before lighting, and an operating point Q, located in the area fb along the curve g2, represents the state after lighting.

ΔF is a difference between individual frequencies at the operating points P and Q, and corresponds to ΔV. That is, in this embodiment, the input/output characteristic of the V/F converter 6*a* is a linearity extended substantially to the right and downward. As described above, when during the frequency fixing period the input of the error amplifier 14 is adjusted and the output voltage of the error amplifier 14 is dropped by ΔV, the frequency of the signal output by the V/F converter 6*a* is increased by ΔF, following the elapse of the timing for the period, so that the frequency can be shifted to the area fb.

The present invention is not limited to the example wherein, in consonance with the input/output characteristic of the V/F converter, the frequency Fout is dropped as the voltage Vin is increased, and also can be applied for an example wherein the frequency Fout is increased as the voltage Vin is increased. In this case, during the frequency fixing period, the voltage applied to the V/F converter may be changed by a predetermined value, and following the elapse of the timing for the period, the frequency may be shifted, by a predetermined displacement value ΔF, to a frequency area (fb) that is higher than f2.

For the lighting method described above, i.e., for the discharge lamp lighting method whereby DC/AC conversion is affected using a transformer, switching devices and a capacitor are employed for a resonant series circuit, which includes a transformer or an inductance device and a capacitor, and the lighting shift control processes are performed in the following manner.

(1) Before the Lighting of a Discharge Lamp:

The switching devices are driven so that the drive frequency of the switching devices constituting the DC/AC converter gradually approaches the frequency f1 (the resonance frequency of the resonant series circuit in the turned-off state). Then, when the OCV value at which the discharge lamp can be turned on is reached, a start signal is supplied to activate the discharge lamp.

(2) After Lighting of the Discharge Lamp:

First, the frequency immediately before the lighting control (the drive frequency during the OCV control process) is fixed for a predetermined period of time. During this period, the input of the error amplifier 14 is employed to provide a ΔV change. For this, if the drive frequency of the switching devices immediately before the discharge lamp is turned on is employed as a reference, the drive frequency is defined that is being higher than this reference by a predetermined displacement value ΔF. Thus, the drive frequency of the switching devices is shifted to a frequency area (fb) that is higher than "f2" (the resonance frequency of the resonant series circuit at the ON time). At this time, the area fb is an inductive area, along the resonance curve at the ON time, wherein the level of the output voltage is equal to or higher than Lmin.

In this embodiment, in FIG. 3, the output of the controller 6*d* is supplied directly to the V/F converter 6*a* at the succeeding stage. However, the present invention is not limited to this arrangement, and various other arrangements can be employed. For example, a time constant circuit, such as a CR integrating circuit, may be provided between the controller 6*d* and the V/F converter 6*a*, and may be used to set a time constant for designating the speed at which the frequency is shifted to the area fb so that a steadier lighting control is performed.

According to the arrangement for this embodiment, various advantages, described below, may be obtained.

For the shifting of the frequency from the OCV control range for the turned-off state to the frequency area fb for the lighted state, stable lighting control can be provided for the discharge lamp.

Frequency shifting is less adversely affected by characteristic part discrepancies, in that a resonance frequency, or a frequency displacement value ΔF, can be determined that has little affect on fluctuations of the resonance frequencies f1 and f2.

Measures taken to cope with high frequency control prevent the occurrence of complicated circuit configurations and remarkable rises in manufacturing costs.

The circuit structure can be simplified by providing an error amplifier used in common by a power operating unit (6*e*) and an OCV controller (6*c*).

As a pair of switching devices (5H and 5L) and a transformer (7) are provided and are used both for AC conversion and for boosting a start signal, such a circuit structure is effective for downsizing and cost reduction.

Other implementations are within the scope of the claims.

What is claimed is:

1. A discharge lamp lighting circuit comprising:

a DC/AC converter for performing AC conversion upon the reception of an input DC voltage;

a starting circuit for supplying a start signal to a discharge lamp; and a control unit for controlling power output by the DC/AC converter, wherein the DC/AC converter includes a plurality of switching devices to be driven by the control unit, and a series resonant circuit that includes either an inductance device or a transformer and a capacitor, wherein, the DC/AC converter is configured such that, if a resonance frequency for the series resonant circuit when the discharge lamp is turned off is denoted by "f1", and if a resonance frequency of the series resonant circuit when the discharge lamp is turned on is denoted by "f2", before the discharge lamp is turned on, the switching devices are controlled so that a drive frequency for the switching devices gradually approaches f1, and so that the start signal is supplied to the discharge lamp by the starting circuit, wherein, the discharge lamp is configured so that, after lighting of the discharge lamp has been initiated, if the drive frequency for the switching device immediately before the discharge lamp is turned on is employed as a reference, the drive frequency is defined at a level higher by a predetermined frequency displacement value than the reference so that the drive frequency of the switching devices is shifted to a frequency area higher than f2.

2. A discharge lamp lighting circuit according to claim 1, wherein the DC/AC converter includes a transformer that has an AC conversion function and a boosting function related to a start signal; wherein a series resonant circuit is constituted by the capacitor and an inductance component of the transformer, or an inductance device connected to the capacitor; and wherein, when a resonance voltage generated on a primary side circuit of the transformer is boosted by the transformer, power is supplied to the discharge lamp connected to a secondary side circuit of the transformer.

3. A discharge lamp lighting circuit according to claim 1, wherein the control unit includes a voltage-frequency converter to provide a frequency signal in accordance with an input voltage, and controls the drive frequency for the switching devices in accordance with the frequency for the signal from the voltage-frequency converter; and wherein, after the lighting of the discharge lamp has been initiated, an output of the voltage-frequency converter is changed by a predetermined quantity that defines the predetermined frequency displacement value.

4. A discharge lamp lighting circuit according to claim 2, wherein the control unit includes a voltage-frequency converter to provide a frequency signal in accordance with an input voltage, and controls the drive frequency for the switching devices in accordance with the frequency for the signal from the voltage-frequency converter; and wherein, after the lighting of the discharge lamp has been initiated, an output of the voltage-frequency converter is changed by a predetermined quantity that defines the predetermined frequency displacement value.

5. A discharge lamp lighting circuit according to claim 3, wherein, for a predetermined period immediately after lighting is initiated, the drive frequency for the switching devices is fixed and the input to the voltage-frequency converter is changed by a predetermined value; and wherein, after the predetermined period has elapsed, the drive frequency of the switching devices is increased by the predetermined frequency displacement value, and is shifted to a frequency area higher than f2.

6. A discharge lamp lighting circuit according to claim 4, wherein, for a predetermined period immediately after lighting is initiated, the drive frequency for the switching devices is fixed and the input to the voltage-frequency converter is changed by a predetermined value; and wherein, after the predetermined period has elapsed, the drive frequency of the switching devices is increased by the predetermined frequency displacement value, and is shifted to a frequency area higher than f2.

* * * * *